United States Patent [19]

Sabino, Jr.

[11] 4,021,136

[45] May 3, 1977

[54] CENTRIFUGAL PUMP

[75] Inventor: Frank Sabino, Jr., Monroeville, Pa.

[73] Assignee: Westinghouse Electric Corporation, Pittsburgh, Pa.

[22] Filed: Feb. 11, 1976

[21] Appl. No.: 656,994

[52] U.S. Cl. ..... 415/111; 415/175; 415/112

[51] Int. Cl.[2] ..... F04D 29/10

[58] Field of Search ..... 415/175, 176, 110, 111, 415/112, 177

[56] References Cited

UNITED STATES PATENTS

| | | | |
|---|---|---|---|
| 2,799,227 | 7/1957 | Allen | 415/112 |
| 3,213,798 | 10/1965 | Carswell | 415/176 |
| 3,459,430 | 8/1969 | Ball | 415/112 |
| 3,620,639 | 11/1971 | Gaffal | 415/111 |
| 3,652,179 | 3/1972 | Hagen | 415/175 |
| 3,732,029 | 5/1973 | Raymond et al. | 415/176 |

*Primary Examiner*—Henry F. Raduazo

*Attorney, Agent, or Firm*—M. S. Yatsko

[57] ABSTRACT

A centrifugal pump for use in pumping hot liquids under pressure. A rotatable shaft, having an impeller at its lower end, is positioned along the axis of a generally cylindrical pump casing. The pump casing has a suction nozzle at its lower end, and a discharge nozzle near the upper end. A cylindrical outer shell surrounds the shaft within the casing, and a flange on the outer shell is secured to the top of the casing. A cylindrical inner shell is positioned inside the outer shell, surrounding the shaft, and a space is formed between the inner shell and the outer shell. The space provides an effective thermal barrier to protect the shaft. A bearing assembly for the shaft is secured to the inner shell, and a cooler is positioned between the bearing assembly and the impeller, thereby protecting the bearing assembly from the heat of the fluid being circulated by the pump. Seals are inserted within the inner shell above the bearing assembly, and these seals confine the high-pressure liquid within the pump.

5 Claims, 1 Drawing Figure

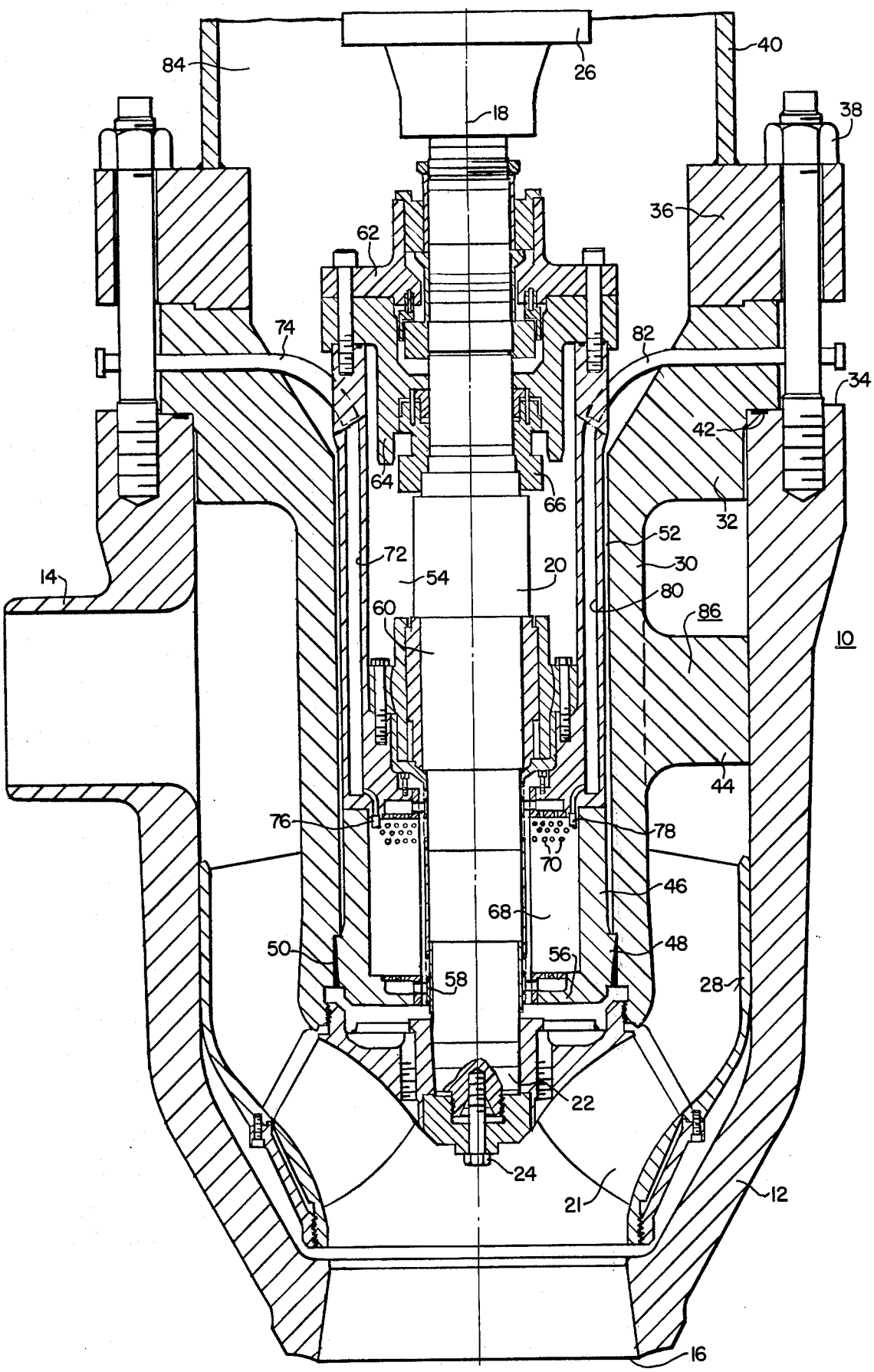
84
26
40
18
38
36
62
74
82
34
42
64
66
32
52
72
30
54
20
14
80
60
86
10
44
76
78
70
46
68
50
48
56
58
28
22
24
21
12
16

CENTRIFUGAL PUMP

BACKGROUND OF THE INVENTION

This invention relates generally to hydraulic pumps, and more particularly to centrifugal pumps for pumping hot liquid under pressure.

Prior centrifugal pumps have generally had a casing containing a main flange to form an enclosed area for the liquid to be pumped, and a cooler, bearing assembly, and seals all mounted above the main flange area of the pump structure. The location of these elements required an expensive casing and a relatively long pump structure. In order to minimize costs, it is desirable to position the seals, bearings, and coolers beneath the main flange area within the casing. In this location, these elements are generally surrounded by the hot liquid, and means must be utilized to thermally insulate these elements.

Thermal barriers have generally been inserted into the casing surrounding the shaft, and its associated elements, to prevent the hot liquid from coming in contact with the elements, and to thermally insulate them. These thermal barriers have generally included either an insulation material sheathed in a metallic casing, or concentric, spaced apart cylinders. These types of thermal barriers have not proven effective, especially for large centrifugal pumps where difficulties in fabrication are encountered.

Additionally, another problem occurs with these types of thermal barriers. The thermal expansion of these barriers between the high temperature side and the low temperature side, and the relative expansion therefrom, causes shearing forces. Because these barriers are held securely in position, these shearing forces have caused cracking and deformation problems.

SUMMARY OF THE INVENTION

The aforementioned disadvantages of the prior art are eliminated by this invention by providing a centrifugal pump with an increased effectiveness thermal barrier which compensates for differential thermal expansion. A generally cylindrical casing is open at one end, and the casing has a discharge nozzle near the upper end and a suction nozzle at the lower end thereof. A rotatable shaft extends along the axis of the casing, and an impeller is attached adjacent the lower end of the shaft. A generally cylindrical outer shell is positioned in, and secured to, the casing. A cylindrical inner shell, having a radially outwardly extension around the lower portion, is positioned within the outer shell, and the radially outwardly extension is hermetically secured to the outer shell. Between the inner shell and the outer shell is formed an annular space. A bearing assembly is secured to the inner shell, and the bearing assembly rotatably receives the shaft. Means for sealing the inside of the inner shell are positioned above the bearing assembly, and a cooler is positioned within the inner shell beneath the bearing assembly.

BRIEF DESCRIPTION OF THE DRAWING

Reference is now made to the description of the preferred embodiment, taken in connection with the accompanying drawing, which is a view, partially in section and partially in elevation, of a centrifugal pump embodying the principal features of the invention.

DESCRIPTION OF THE PREFERRED EMBODIMENT

Referring now more particularly to the drawing, the centrifugal pump 10 shown therein comprises a generally cylindrical casing 12 having a radial discharge nozzle 14 near the upper end of the casing 12, and a suction nozzle 16 at the lower end of the casing 12. The pump 10 is suitable for circulating a liquid in a circulation system at a relatively high temperature and a high pressure. Suitable connections may be made to the suction nozzle 16 and to the discharge nozzle 14 to enable the pump 10 to circulate the liquid in the system. The casing 12 is generally symmetrical about the casing axis 18, excepting the discharge nozzle 14. A rotatable shaft 20 is positioned in the center of the casing 12, and generally extends along the axis 18 of the casing 12. An impeller 21 is secured adjacent the lower end 22 of the shaft 20, by means such as the bolt 24. The impeller 21 is positioned in the path between the suction nozzle 16 and the discharge nozzle 14. The shaft 20 may be driven by an electric motor (not shown), and the shaft of the motor is connected to the shaft 20 of the pump 10 by means of a coupling 26. A diffuser 28 is positioned adjacent the suction inlet nozzle 16, and the diffuser 28 channels the fluid entering through the suction nozzle 16 into the pump 10.

A generally cylindrical outer shell 30 is positioned within, and coaxial with, the casing 12. The outer shell 30 has a flange 32 which extends radially outwardly from the upper periphery thereof, and this flange 32 is secured to the top 34 of the casing 12. One means of securing the flange 32 to the top 34 of the casing 12 is by placing a motor mount 36 on top of the flange 32, and the motor mount 36 is then bolted to the casing 12 by means of a bolt 38. The flange 32 and the outer shell 30 are thereby secured to the top 34 of the casing 12 by means of friction forces and the compression forces of the bolt 38. The motor mount 36 supports the motor (not shown) by means of the motor support 40. A gasket 42, or other means, are utilized to seal the joint between the flange 32 and the casing 12.

Between the outer shell 30 and the casing 12, and beneath the flange 32 is formed an area 43 through which the hot liquid flows. Turning vanes 44 are secured to the outer shell 30, and these turning vanes 44 provide a means for directing liquid from the diffuser 28 to the discharge nozzle 14. A generally cylindrical inner shell 46 is positioned within the outer shell 30, is coaxial with the outer shell 30, and has an outwardly radial extension 48 around the lower portion thereof. This radial extension 48 is hermetically secured to the outer shell 30, by means such as a weld 50. Between the inner shell 46 and the outer shell 30 is formed an annular first space 52. Between the inner shell 46 and the shaft 20 is formed an annular second space 54. To prohibit large amounts of liquid from flowing into the second space 54, the inner shell 46 has a bottom section 56. The bottom section 56 has an opening 58 through which the shaft 20 passes. The only liquid which can flow into the second space 54 is that which would flow through the opening 58 adjacent the shaft 20. A radial bearing assembly 60 is secured to the inside of the inner shell 46. This bearing assembly 60 rotatably receives the shaft 20.

Vertically above the bearing assembly 60 within the second space 54 are seals 62, 64, 66. The seals 62, 64, 66 are secured to the inner shell 46, and seal the second space 54. The seals 62, 64, 66 also rotatably received the shaft 20. The liquid flowing through the pump 10 is then maintained at its high pressure within the area bounded by the outer shell 30, the flange 32, the casing 12, and the seals 62, 64, 66.

Vertically beneath the bearing assembly 60, and within the second space 54, is inserted an annular cooler 68. In this location, the cooler 68 is located intermediate the bearing assembly 60 and the impeller 21. The cooler 68 is comprised of one or more coils 70 through which a cooling liquid can pass. The function of the cooler 68 is to cool any liquid which may flow from the impeller 21, alongside the shaft 20, and up to the bearing assembly 60 and the seals 62, 64, 66, and to thermally insulate the second space 54 from the hot liquid.

In order to supply cooling liquid to the coils 70, two openings are drilled through the inner shell 46. An inlet opening 72 is connected through piping 74 to a suitable supply of cooling liquid (not shown). The inlet opening 72 is in fluid communcation with the coil 70 by suitable means such as the pipe 76. After flowing through the coil 70, the cooling liquid flows into piping 78, into an outlet opening 80, and through outlet pipe 82 to suitable disposal. Thus, it can be seen that the openings 72 and 80 together comprise a means for supplying cooling liquid to the cooler 68 and a means for removing the liquid from the cooler 68.

As is apparent from the drawing, unlike the majority of prior art pumps, the centrifugal pump 10 of this invention does not utilize a main flange to contain the hot liquid within the pump 10. The flange 32 which is part of the outer shell 30 is only present externally of the thermal barrier 86, the thermal barrier 86 being comprised of the outer shell 30, the inner shell 46 and the first space 52. The first, on air, space 52 is an effective thermal shield, and this space 52 is vented to the atmosphere through openings 84 in the motor support 40. In this manner, the heat which is transferred by the liquid through the outer shell 30 can then be dissipated into the external atmosphere, thereby resulting in an increase of the effectiveness of the thermal barrier 86. Additionally, the non-necessity of a complete covering flange decreases fabrication costs of the pump 10.

In addition to increasing the effectiveness of the thermal barrier 86, the pump 10 of the invention also compensates for thermal expansion of the thermal barrier 86. The difference in temperature between the outer shell 30 and inner shell 46 may be as much as 400° F or more. Because of this large temperature differential, the linear thermal expansion of the shells 30, 46 would not be expected to be the same; the outer shell 30 will grow more than the inner shell 46. However, the inner shell 46 is only secured at one location, mainly the weld 50 at the extension 48 of the inner shell 46. Therefore, when the expansion of the outer shell 30 occurs, for example downward, the inner shell 46 can move downward with the outer shell 30. The elements which are secured to the inner shell 46 likewise move downward with the inner shell 46. This movement would not have been possible in prior pump designs because the elements corresponding to the inner shell had to be secured (welded) to the main flange.

Thus, the centrifugal pump disclosed increases the effectiveness of the thermal barrier, allowing the bearings and seals to be placed within the pump cavity itself, resulting in reduced cost, while additionally providing compensation for the differing thermal growths associated with the thermal barrier.

I claim as my invention:

1. A vertically positioned centrifugal pump for circulating a liquid comprising:

a generally cylindrical casing open at one end, said casing having a discharge nozzle and a suction nozzle formed therein;

a rotatable shaft extending along the axis of said casing;

an impeller attached adjacent a lower end of said shaft, said impeller being generally positioned in the path between said suction nozzle and said discharge nozzle;

a generally cylindrical axially extending outer shell positioned within said casing and coaxial with said casing, said outer shell having a flange extending radially outwardly from the upper periphery thereof, said outer shell flange being secured to the top of said casing, said casing, said outer shell, and said outer shell flange forming an area therebetween through which said liquid to be circulated flows;

a generally cylindrical axially extending inner shell positioned within said outer shell and coaxial with said outer shell, said inner shell having an outwardly radial extension around the lower portion thereof, said inner shell being hermetically secured to said outer shell at said inner shell radial extension, said inner shell at the upper portion thereof being spaced apart from said outer shell flange, said inner shell and said outer shell forming an annular first space therebetween, in open communication with the exterior of said casing, said inner shell and said shaft forming an annular second space therebetween;

a bearing assembly secured to said inner shell in said second space, said bearing assembly rotatably receiving said shaft;

means for sealing said second space secured to said inner shell, said means for sealing said second space being positioned vertically above said bearing assembly, said means for sealing said second space receiving said shaft; and an annular cooler positioned within said second space vertically below said bearing assembly, said cooler rotatably receiving said shaft.

2. The pump according to claim 1 including a diffuser extending generally upwardly from said impeller within said casing.

3. The pump according to claim 2 including means for directing liquid from said diffuser to said discharge nozzle.

4. The pump according to claim 1 wherein said cooler comprises at least one coil for circulating a cooling liquid therein, said inner shell having an inlet opening therein, said inner shell inlet opening being in fluid communication with said coil, and means for supplying a cooling liquid to said inner shell inlet opening.

5. The pump according to claim 4 wherein said inner shell has an outlet opening therein, said inner shell outlet opening being in fluid communication with said coil, and means for removing cooling liquid from said inner shell outlet opening.

* * * * *